United States Patent [19]

Loredo

[11] 3,976,194

[45] Aug. 24, 1976

[54] COMBINED CIGARETTE PACK AND DISPOSABLE LIGHTER

[76] Inventor: Adolfo Arias Loredo, Apartado 741, Panama, Panama

[22] Filed: Aug. 10, 1973

[21] Appl. No.: 387,373

[52] U.S. Cl. ..... 206/87; 431/253

[51] Int. Cl.[2] ..... A24F 15/18; F23D 3/18

[58] Field of Search ..... 206/89, 87, 91, 90; 431/253

[56] References Cited

UNITED STATES PATENTS

| | | | |
|---|---|---|---|
| 1,604,838 | 10/1926 | Morden | 206/90 |
| 1,677,036 | 7/1928 | Kratochwill | 206/91 |
| 2,811,247 | 10/1957 | Stevenson | 206/90 |
| 3,057,180 | 10/1962 | Steppan | 206/87 X |
| 3,594,108 | 7/1971 | Villareal-Cuevo | 431/254 |
| 3,608,704 | 9/1971 | Kopp | 206/87 |

FOREIGN PATENTS OR APPLICATIONS

| | | | |
|---|---|---|---|
| 707,489 | 4/1931 | France | 206/87 |
| 462,948 | 3/1937 | United Kingdom | 206/87 |

*Primary Examiner*—Leonard Summer

*Attorney, Agent, or Firm*—Burns, Doane, Swecker & Mathis

[57] ABSTRACT

A combined cigarette pack and disposable lighter which will have sufficient capacity to ignite the quantity of cigarettes in the pack. The lighter is incorporated in the pack as a part thereof and preferably is accessible at the open end of the pack. The parts of the lighter are fabricated to fit in compact space and the lighter is as inexpensive as possible, to be readily disposable with the empty pack.

9 Claims, 21 Drawing Figures

FIG. 1A
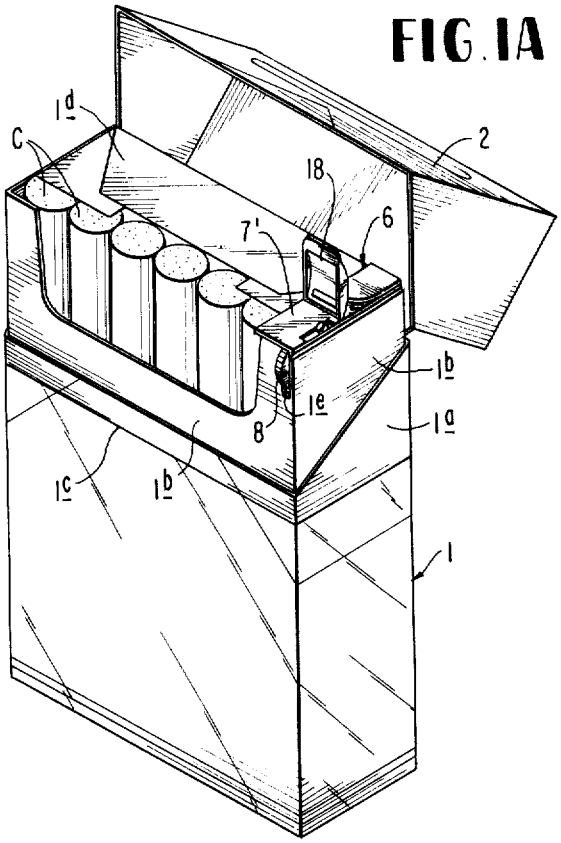
FIG. 1B
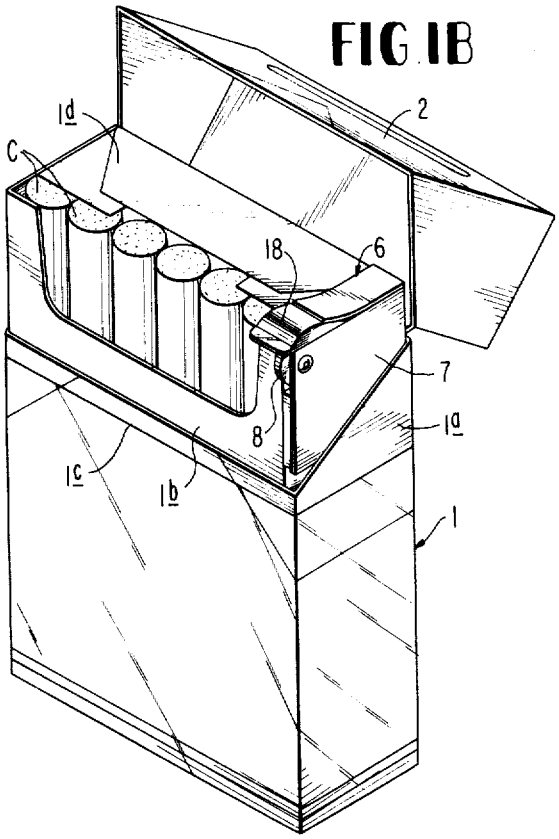
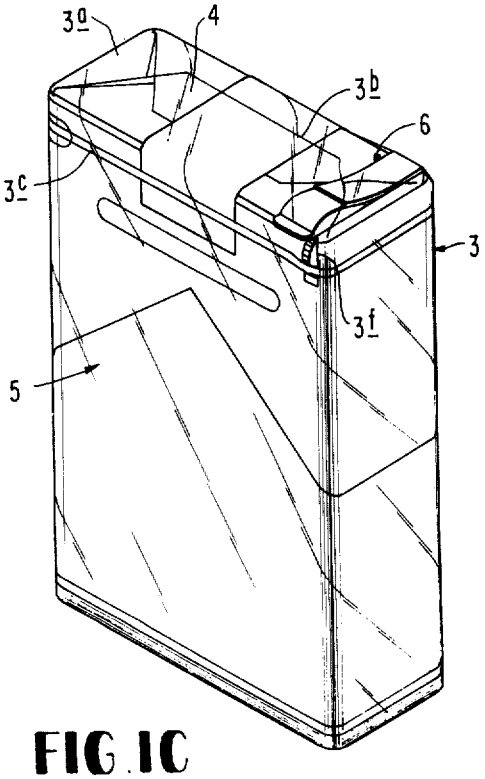
FIG. 1C
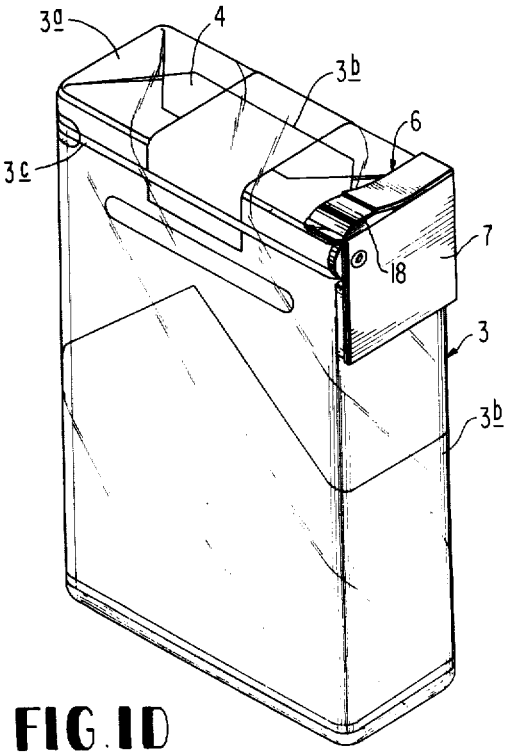
FIG. 1D

FIG. 7A
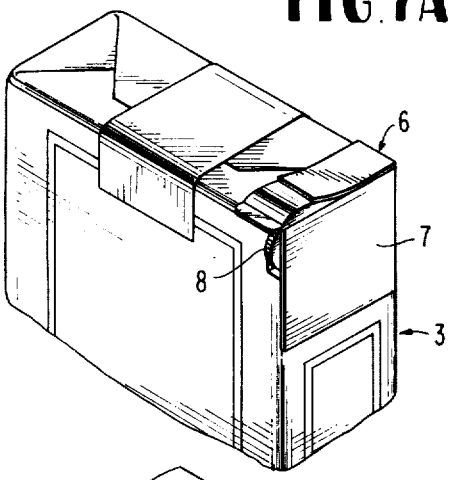
FIG. 7B
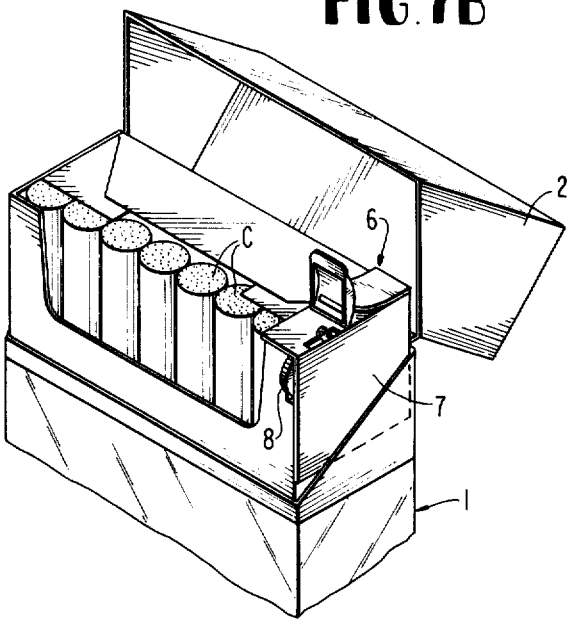
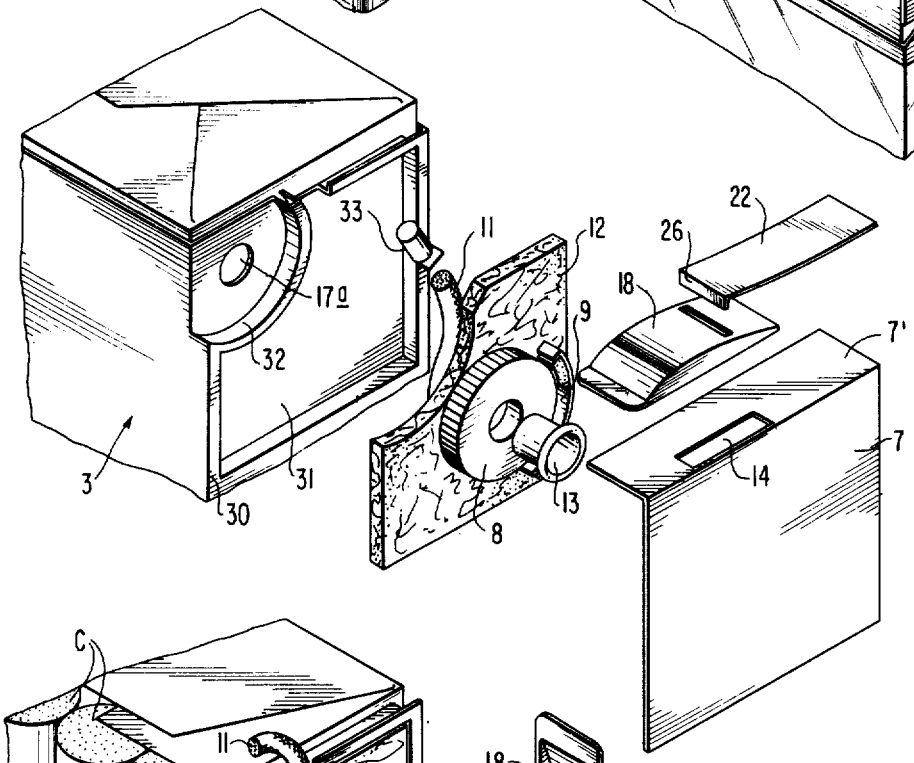
FIG. 8A
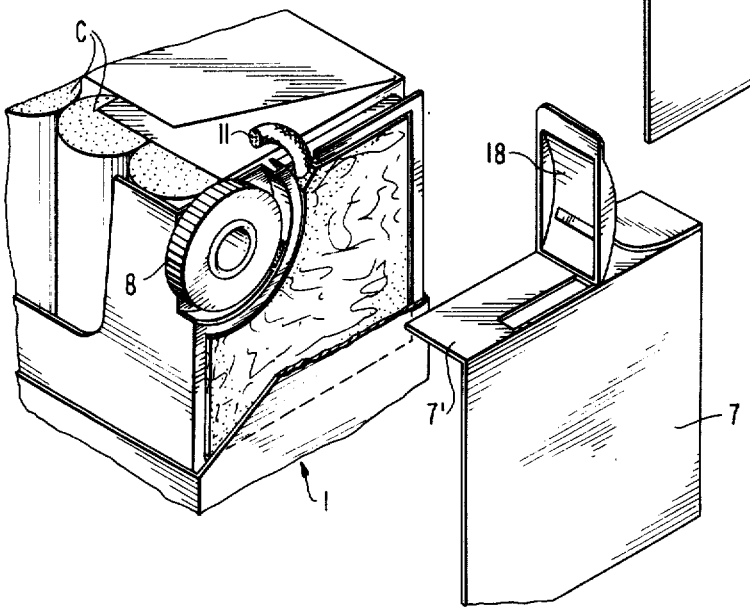
FIG. 8B

FIG. 9A
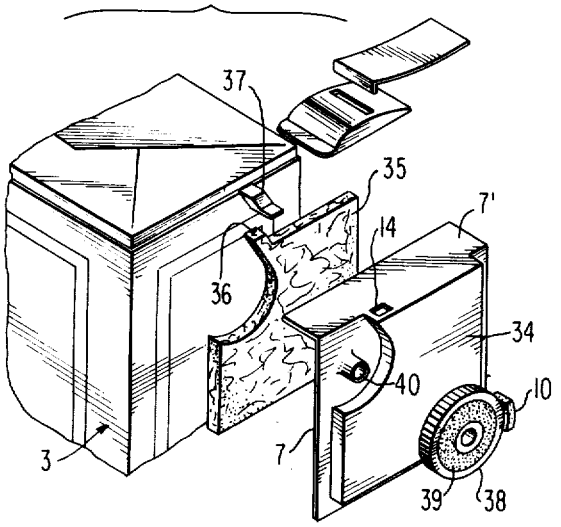
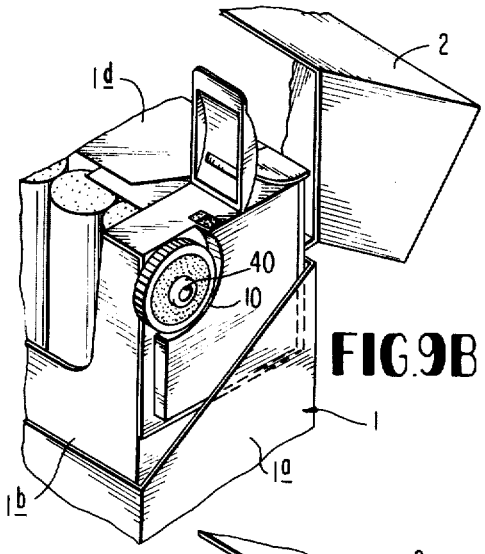
FIG. 9B
FIG. 10A
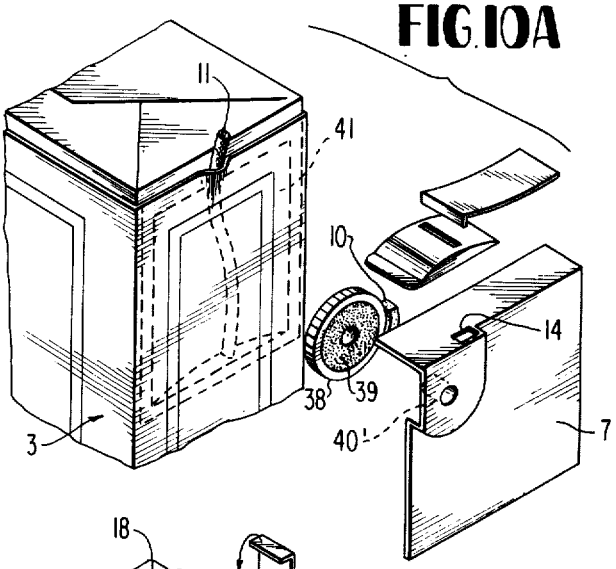
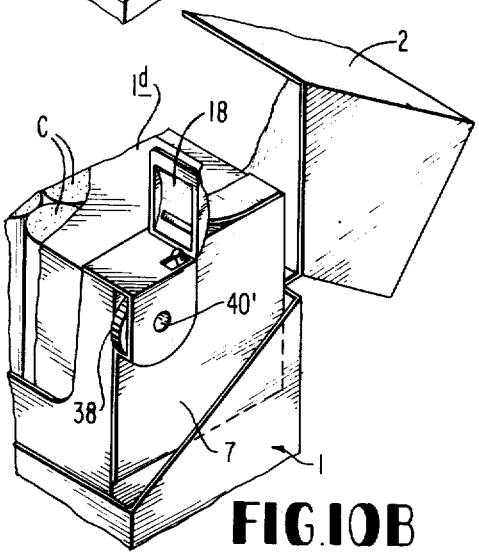
FIG. 10B
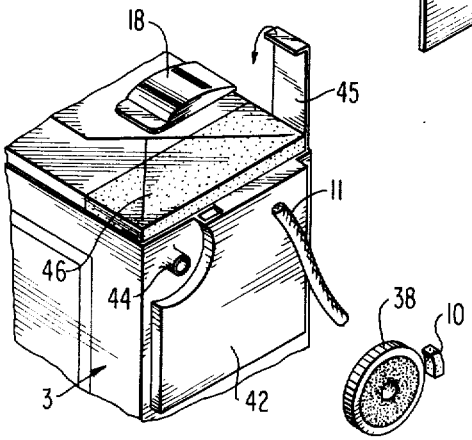
FIG. 11A
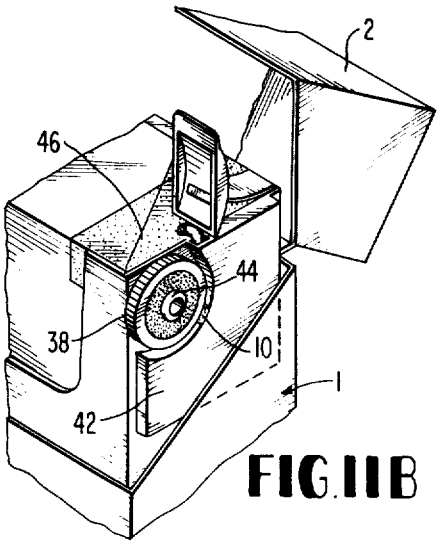
FIG. 11B

COMBINED CIGARETTE PACK AND DISPOSABLE LIGHTER

SUMMARY OF THE INVENTION

This invention relates to improvements in cigarette packs, to include as an integral part thereof a disposable lighter incorporated in the pack, preferably at the open end thereof.

It has been customary heretofore to provide separate igniting means, such as matches or a lighter, for the cigarettes contained in a pack. Lighters are expensive to manufacture and bulky to carry. Matches are troublesome and also bulky.

The main object of the invention is to provide a combined cigarette pack and lighter that can be sold to the public as a combined unit.

Another object of the invention is to provide cigarette package structures having part of the structure constituting part of a complementary lighter structure.

Another object of the invention is to provide cigarette lighter structures forming part of a cigarette package structure.

Another object of the invention is to provide a type of lighter structure that can be adapted to the usual type of cigarette packs as a standard part of the pack, so as to be sold with the pack at no extra cost or at an insignificant extra cost. The idea is to provide with a pack of cigrarettes a lighter for the cigarettes contained within and to be discarded with the empty pack.

Another object of the invention is to provide a lighter structure so that it can be integrated with a cigarette pack in the easiest and most inexpensive way possible.

Another object of the invention is to construct and adapt the lighter structure so that it is easy and comfortable to use.

Still another object of the invention is to construct and locate such lighter structure so as to prevent the pack of cigarettes from coming into contact with the flame, thus making it safe to use.

A further object of the invention is to so construct such lighter structure that it does not affect the original appearance of the pack, but instead will blend favorably with it. The lighter structure should not present an unnecessary additional bulk to the pack of cigarettes, but instead be as compact as possible so as to be easily camouflaged.

Still another object of the invention is to design such lighter structure so that it can be incorporated in most cigarette packs without requiring any significant change in the structure or in the pack and they will blend together.

Another object is to design, simplify and arrange each and all of the component parts of the lighter structure for the utmost interrelated compactness, in order to minimize the space required by the unit.

It is a further object of the invention to design the fuel reservoir for igniting means, large enough to contain just sufficient fuel to service an entire pack of cigarettes, and of such design as to occupy as little space in the combined assembly as possible.

It is another object of the invention to simplify the design of each individual part, reduce their number to a minimum, and interrelate in such a way as to be able to manufacture at a cost sufficiently low to make the same commercially feasible.

Fundamentally, the invention consists of integrating with a cigarette pack a disposable lighter structure capable of servicing all of the cigarettes in the pack, and designed specifically to be adapted to function as part of the pack, and then to be discarded, together with the empty pack.

The invention makes it possible for customers to buy at an insignificant extra cost, cigarette packs with an integrated light source, so that a cigarette can be lighted in the most convenient way. It would make possible for the cigarette pack to act as a lighter for the cigarettes contained in the pack.

The lighter structure may be incorporated preferably at the right hand edge of the open end of the pack, where it is most convenient for the smoker to use. The igniting means, as for example, the spark wheel and the wick or gas nozzle, should be located preferably towards the front of the pack, in order for the lighter structure to be operated with maximum ease.

Installing the lighter structure in this manner would provide convenient accessibility to the lighter structure and comfortable use; the pack does not need to be tilted or turned for lighting a cigarette, but only drawn closer to it.

BRIEF DESCRIPTION OF DRAWINGS

Certain embodiments of the invention are shown both as a pack of cigarettes with a lighter, and also as a separate lighter, in the accompanying drawings, in which:

FIG. 1A is a perspective view of a flip-top cigarette pack with the lighter structure incorporated on the inside wall of the box, with the cap open;

FIG. 1B is a perspective view of the lighter structure incorporated between the outer wrapper and the inner wrapper of the flip-top box, and with the lighter cap closed;

FIG. 1C is a perspective view of a soft-type cigarette pack with the lighter structure incorporated on the inside of the outer wrapper and with the lighter cap closed and in a transparent enclosure thereof;

FIG. 1D is a perspective view of the soft pack type cigarette pack, with the lighter structure incorporated on the outside of the cigarette pack and with the lighter cap closed;

FIG. 7A is a perspective view of the upper section of a soft-type cigarette pack, with the lighter structure incorporated in the upper right-hand side of the pack on the outside of the outer wrapper;

FIG. 7B is a perspective view of the upper section of flip-top box type cigarette pack, with a lighter structure incorporated in the upper right-hand side of the pack on the outside wall of the inner part of the pack;

FIG. 8A is a perspective view of a lighter structure, with the parts disassembled and shown in relation to a part of a soft-type cigarette pack forming a component thereof;

FIG. 8B is a similar view, showing the parts partly assembled on a flip-top box-type cigarette pack;

FIG. 9A is a perspective view of a portion of a soft-type cigarette pack and a lighter structure, with the parts disassembled;

FIG. 9B is a perspective view of a similar type of lighter structure assembled on a flip-top box-type cigarette pack;

FIG. 10A is a perspective view of another type of lighter structure, with the parts disassembled and showing a connected portion of a soft-type cigarette pack having a part of the lighter structure incorporated therein;

FIG. 10B is a perspective view of a similar lighter structure wherein a part of the lighter structure is incorporated in a flip-top box-type cigarette pack;

FIG. 11A is a perspective view of a lighter structure in partially disassembled relation and wherein the cigarette pack forms a part of the lighter structure; and FIG. 11B is a perspective view of a similar type of lighter structure in assembled relation and incorporated in connection with a flip-top box-type cigarette pack.

DETAILED DESCRIPTION OF DISCLOSURE

FIGS. 1A to 1D show several ways in which the disposable lighter structures can be incorporated in a cigarette pack. FIG. 1A and FIG. 1B show the lighter structure incorporated in the inside of a flip-top box-type cigarette pack. FIG. 1C and FIG. 1D show the lighter structure incorporated in a soft-type cigarette pack. In all four cases, the lighter structures are shown incorporated at the top right hand section of the cigarette pack at the open end thereof.

These are merely representative of many different types and sizes of cigarette packs in connection with which this invention may be adapted. In FIGS. 1A and 1B, the flip-top box-type of cigarette pack has the pack indicated generally at 1, with the hinged top shown at 2, for enclosing the cigarettes C. The pack 1 is shown for illustration purposes as having a surrounding wall 1*a* with an inside liner 1*b* which together enclose the cigarettes C. The wall and liner are usually made of thin cardboard. The entire pack is then encased in a sealing enclosure 1*c*, often made of cellophane. The cigarettes are enclosed in an inner wrapper 1*d*.

In FIGS. 1C and 1D, the cigarettes (not shown) are enclosed within an outer wrapper 3, preferably of paper, plastic or other wrapping material. The cigarettes are enclosed in an inner wrapper 3*a* which is sealed at the top at 4. One or more side walls of the pack may have a labeling or printing area 5. A portion of the top seal 4 is often torn away to expose the cigarettes. The entire pack is encased in a sealing enclosure, such as cellophane, 3*b*, often having opening means such as a tear strip 3*c*.

The lighter structure is generally designated at 6 and preferably is located at the right hand edge of the open top of the pack 1 or 3, so as to be readily accessible at the open end thereof.

In this specification I describe different types of disposable lighter structures, used either with gas, such as butane, or with a liquid fuel such as naphtha. The lighter structure have basically the same design, but differ a little in component parts. However, they cost approximately the same to manufacture and they may be integrated with cigarette packs in the same way.

Figure 2:
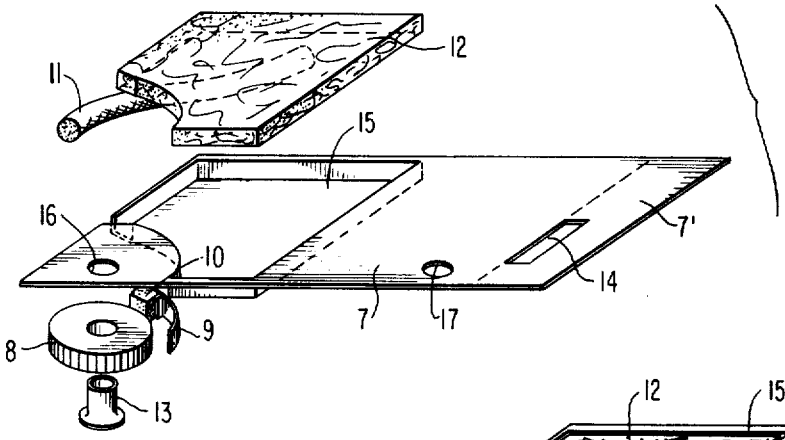
FIG. 2 is a perspective view of the component parts of the liquid fuel disposable lighter structure disassembled, with the lighter cap not shown in order to simplify the drawing.
Figure 3:
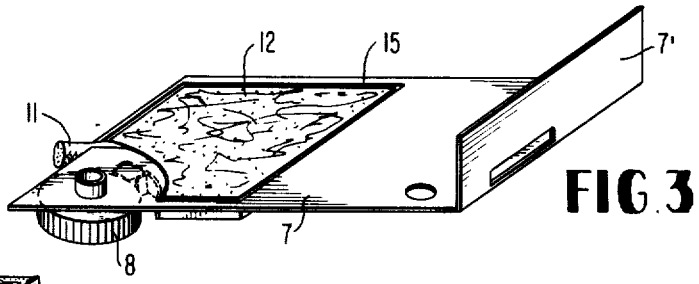
FIG. 3 is a perspective view of the component parts of the liquid fuel disposable lighter structure assembled, but without a cap.

FIGS. 2 and 3 show one form of liquid fuel disposable lighter structure consisting of: the main supporting body 7, a spark wheel 8, a leaf spring 9 having a U-grip on one end, a flint 10, a wick 11, a piece of impregnable material 12, and a rivet 13.

The supporting body 7 may be made of any suitable material, preferably metal, plastic, fabric or paper. It has a rectangular hole 14 that serves as an opening for the wick 11 to protrude from the unit. It also has an impressed box-like space 15 shaped like the part 12, which serves as a fuel reservoir for the unit, and also contains the parts 11 and 12. The leaf spring 9 is attached at one end to the outer face of the fuel reservoir 15. The rivet 13 fits through holes 16 and 17 to fix the spark wheel 8 to the unit and as a journal for the spark wheel. A rectangular section 7' of the body 7 should be constructed to be non-inflammable and is bent at 90° from the rest of the unit, in order to form shield and prevent the flammable part of the cigarette pack from coming in contact with the flame of the lighter structure.

Figure 6A:
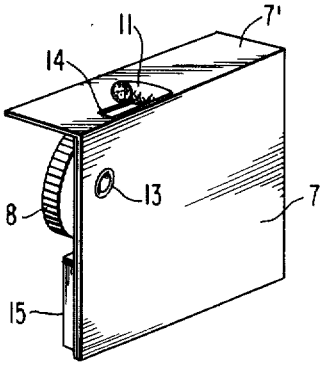
FIG. 6A is a perspective view of the wick-type lighter structure, with the cap omitted.
Figure 6B:
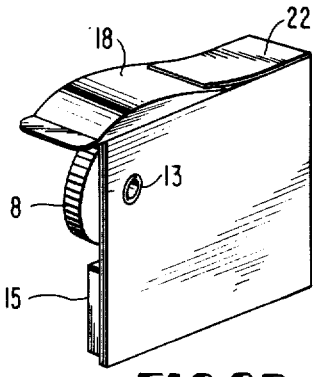
FIG. 6B is a perspective view of a lighter structure complete and with the cap closed.
Figure 6C:
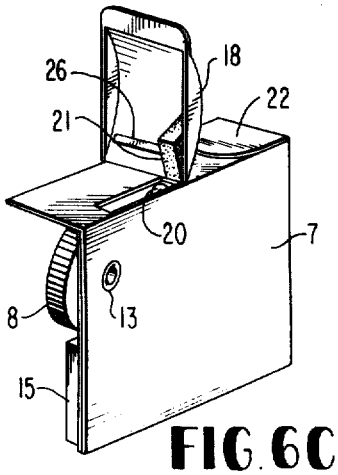
FIG. 6C is a perspective view of the gas lighter structure, with the cap open, showing the sealing piece for the orifice of the gas nozzle when the cap is closed.

The sheet of material forming the body 7, with the section 7' and the reservoir 15, may be stamped from a suitable material, as described, which facilitates an inexpensive construction. The reservoir 15 is then folded up on the body 7, as shown in FIGS. 6A, 6B and 6C, thus enclosing the material 12 and the wick. The section 7' could be turned out at right angles to the body 7 in the same operation. When the sheet of material is folded as described, the holes 16 and 17 will be in alignment for mounting of the spark wheel on the rivet 13, as illustrated and described.

The spark wheel 8 can be manufactured of any suitable material having an abrasive peripheral surface such as steel preferably with grooves on its outer peripheral surface. These grooves can be triangular, in order to produce better friction with the flint 10. The flint 10 is held by the U-grip located on the free end of the leaf spring 9. The leaf spring 9 is designed to press the flint 10 against the spark wheel 8 with the required amount of pressure.

The wick 11 should be compact enough to produce a flame measuring approximately from one-half to three-quarter inch in height, and having a very low rate of fuel consumption. Its diameter should be small, such as, for example, 1/16 inch, in order to minimize the rate of fuel consumption. The wick needs only to protrude from 1/32 to 3/32 inch from the opening 14 in order to produce the right size of flame specified and fit at the same time inside the cap. Once the unit is filled with fuel and is hermetically closed, the protruding part of the wick should be covered with an evaporation seal 33 in order to prevent the fuel from evaporating while the lighter structure is unused. This seal would be removed by the user when he opens the cap 18 of the unit to light the first cigarette.

Figure 4:
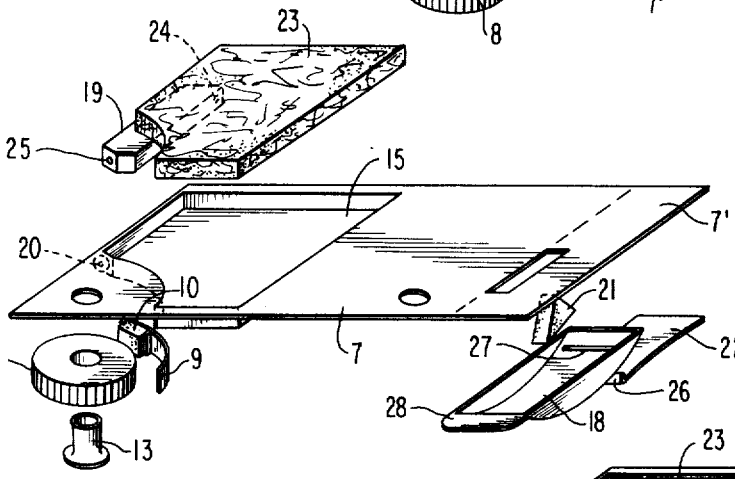
FIG. 4 is a perspective view of the component parts of the gas disposable lighter structure disassembled.
Figure 5:
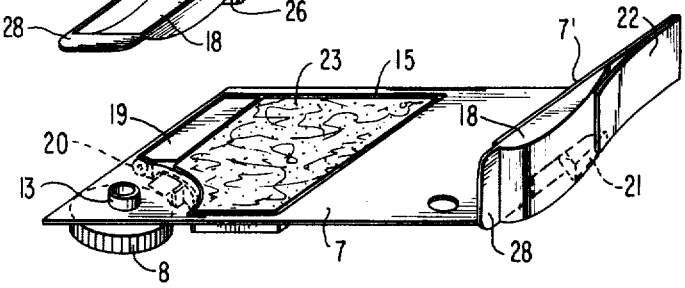
FIG. 5 is a perspective view of the component parts of the gas disposable lighter structure assembled.

FIGS. 4 and 5 show one form of disposable gas lighter structure. As shown, this structure differs basically from the wick lighter structure shown in FIGS. 2 and 3, in that it contains a small pressure regulating device 19 for the gas, and a gas nozzle 20 which consists of an indentation with a tiny orifice in it, made on the smallest of the wall surfaces of the box-like space 15. The cap 18 of the gas lighter structure has a piece of suitable flexible material 21, such as rubber, which seals the orifice 20 of the gas nozzle when the cap is closed.

The cap 18 is designed specifically to fit both types of lighter structures. A leaf spring 22 puts pressure on the cap 18 providing a jack knife type mechanism which makes it very convenient and easy to operate.

Part 23 (FIG. 5) is a piece of impregnable material shaped exactly like part 12 in FIG. 2, but with a piece removed, sufficient to leave enough room to accommodate the pressure regulating device 19 so it will fit in space 15.

As shown in FIG. 4, the pressure regulating device 19 consists of a small, almost perfectly rectangular box with two tiny orifices in it. One of the orifices 24 connects the pressure regulating device with the box-like space 15 and the other orifice 25 connects the pressure regulating device with the gas nozzle 20. The inside of the pressure regulating device contains compressed porous material, such as, for example, cotton, in order to create great frictional resistance on the gas. The pressurized gas stored in the chamber 15 is discharged through orifice 24 and has a first drop in pressure due to the expansion of the gas (throttling effect). The gas then passes through the compressed porous material, resulting in a further drop in pressure due to frictional loss. When the gas is discharged through hole 25, its pressure drops still further due to a second throttling effect on the gas.

The gas then emanates from the orifice of the gas nozzle 20 at a predetermined rate of flow. This rate of flow establishes a constant size of the flame desired, which in this case should preferably measure anywhere from 1/2 to 3/4 inch in height.

The rate of flow of the gas will vary in accordance to the compressibility given to the porous material and the diameters of the orifices 24 and 25 and that of the gas nozzle 20. In this case, the orifice of the gas nozzle 20 can measure, for example, 1/64 inch in diameter, while the other holes 24 and 25 can measure anywhere between 1/100 inch and 1/64 inch in diameter. The porous material should be compressed tight enough to produce the friction on the gas in order to obtain the desired size of flame.

The pressure regulating device 19 can be manufactured by compressing or shape a suitable porous material in a desired manner; and giving it a coating forming a sealing shell all around the unit; and finally making the two tiny orifices in the sealing shell, as shown in FIG. 4. When incorporating the pressure regulating device in the lighter structure, it should be adhered on all contacting sides with a strong adhesive that would act as a seal in order to prevent the gas from leaking to the gas nozzle 20 from the sides of the pressure regulating device 19.

The complete cap assembly for the gas lighter structure consists of a triangular piece of sealing material, such as rubber, 21 (FIG. 4), a leaf spring 22 and the cap 18. The leaf spring 22 has on one end a piece 26, bent at 90°, which serves to hold in place the cap and also as a stop for the cap when it is in the open position. The other end of the leaf spring 22 is attached to the section 7' at one edge thereof. If necessary, the leaf spring 22 can have small projections adjacent to the bent piece 26 so as to prevent the cap 18 from sliding back on the leaf spring while the cap is in an open position.

The cap 18 has a slot 27 which serves to receive the part 26 in it. Part 28 at the end of the cap projects as a contacting surface for opening the cap with the thumb. The sealing piece 21 can be attached to the cap with adhesive or by crimping, and serves to seal the orifice of the gas nozzle 20 when the cap is closed.

The gas lighter structure can be filled by introducing the gas in liquid form and then sealing the unit to prevent any gas from escaping. The orifice of the gas nozzle 20 can be sealed by putting some type of sealant over it, such as, for example, a tiny drop of adhesive material on the sealing piece 21. This is done so that there is absolutely no leakage of the gas in the unit, while th unit is stored unused. This type of seal is very convenient in that it would be automatically broken when the consumer buys the pack of cigarettes and opens the cap 18 to light the first cigarette.

The cap 18 shown in FIG. 4 has been specially designed to be used on both types of units. It is easy and comfortable use, the occupies a minimum additional space. Its design streamlines the top part of the lighter structure, giving it an elegant and more finished look. In the case of the gas lighter structure, the cap contains a piece of flexible material which acts as a seal for the orifice of the gas nozzle. In the wick lighter structure, the cap 18, when closed, serves to decrease the rate of evaporation of the fuel while the unit is in use, as well as to extinguish the flame. If specified, the wick lighter structure can be used without a cap, as shown in FIG. 6A.

The lighter structure illustrated in FIGS. 2 to 6 may be used with any form of cigarette pack as may be found desirable. Examples of such use are illustrated in FIGS. 1A, 1B, 1C, and 1D, wherein the lighter structure is associated with the wrapper for the cigarettes, either between the outer and inner wrappers thereof or between the outer wrapper and the sealing enclosure **1*c***, or on the outside of the cigarette pack.

In FIG. 1A, the supporting member 7 of the lighter structure is located inwardly of the liner **1*b*, with the section 7' extending inwardly thereof overlapping the adjacent cigarettes in the pack. In this instance, the liner 1*b* has a slot 1*e* through which the spark wheel 8 protrudes for access thereto. The cap 18** is shown open.

In FIG. 1B, the supporting member 7 is located externally of the liner **1*b* between the latter and the outside wall 1*a*, with the spark wheel 8** fully exposed.

In FIG. 1C, the lighter structure is enclosed within the outer wrapper of the pack, which may have a slot formed therein, as indicated at **3*f*, for exposing the spark wheel and is fully covered by the sealing enclosure 3*b***.

In FIG. 1D, the lighter structure is externally of the cigarette pack, being secured upon the sealing enclosure **3*b*, and the spark wheel 8 is fully exposed. It may be secured upon the outer wrapper and enclosed by the sealing enclosure, or by securing means that extends through the sealing enclosure 3*b***, or by crimping the lighter structure to the outer wrapper and the sealing enclosure.

The cigarette pack, wrapper or container for the cigarettes, whether a flip-top box or a soft-type cigarette pack can be encased within a sealing enclosure, which also extends around and over the lighter structure, whether inside the pack, as in FIGS. 1A and 1C, or outside the pack, as in FIG. 1B. Thus, the lighter structure and cigarette pack are combined into one unit, which may be packaged or sold as such.

Other embodiments of this invention are illustrated in FIGS. 7 to 11. The cigarette packs here shown are of the same types as described above and generally involve similar elements of a lighter structure except as hereinafter described.

FIGS. 7A and 7B show the upper sections of a soft-pack and flip-top box-type of cigarette pack, respectively, in connection with the lighter structures shown more in detail as applied thereto in FIGS. 8A and 8B, the lighter structures being illustrated as integrated in the upper right-hand side of the respective packs. The parts of the packs are illustrated by numerals corresponding with those heretofore described except as modified in these forms.

According to this embodiment of the invention, the component parts of the lighter structure are built into the pack so as to be substantially flush with the outer surface of the wrappings therefor. This is convenient for use, first because it presents no substantial outer protrusion on the pack, second because it lends itself to full depiction of the brand design and ornamentation on the pack without interference by the lighter structure combined therewith.

In FIG. 8A, the lighter structure is shown disassembled with relation to the pack of FIG. 7A, wherein an end wall 30 on the soft-pack 3 is molded or formed not only to support thereon the lighter structure, but also to be a part thereof. For example, the wall 30 of the wrapper has formed thereon a recessed fuel container 31 and also forms a support for parts of the lighter structure. This has the advantage of being able to manufacture both the fuel container and the supporting means on one molding or forming operation, saving on material and effecting a symmetry of the cigarette pack with a minimum of cost.

According to this embodiment, the fuel receptacle, indicated at 31, formed in the wall 30, is either indented in the wall or molded with a surrounding rib. The wall 30 also has an opening 17*a* in an arcuate indentation 32 of the wall 30 for receiving an end of the rivet 13 after passage through the spark wheel 8 for mounting the spark wheel on the wall 30. The leaf spring 9 supporting the flint 10 is mounted on an arcuate portion 32 formed in the end wall 30. The sheet of impregnable material 12 is enclosed within the fuel reservoir 31, with the wick 11 extending out through a suitable opening to an exposed position.

A suitable sealing element is shown at 33 which may be applied over the open end of the wick to prevent evaporation of the fuel until the package is to be used. This sealing element 33 can be removed readily and discarded.

The other parts of the lighter structure are substantially the same as described above in connection with FIGS. 2 to 6. The supporting body 7 is permanently secured against the face of the wall 30 in any suitable manner as by an effective adhesive, crimping or other means, which not only seals the fuel container, but also maintains the operative parts of the lighter in permanent secure relation to the cigarette pack.

Substantially the same structure is illustrated in FIG. 8B as applied to a flip-flop box-type cigarette pack 1 of the character illustrated in FIGS. 1A and 1B. Here the fuel receptacle 31 is molded or formed in an end wall of the pack 1, the parts being shown as substantially assembled except for the supporting body 7 which is adhesively or otherwise secured permanently to the end wall of the pack, confining the operating parts therein and sealing the fuel receptacle 31.

The section 7' of the supporting structure extends laterally, overlapping the adjacent row of cigarettes C and when the cap 18 is opened, the wick 11 will be exposed for ignition of the fuel upon rotation of the spark wheel 8 in contact with the flint 10.

Another embodiment is shown in FIGS. 9A and 9B as applied to the soft-pack and flip-top box-type cigarette pack. Here the end wall of the container for the cigarettes is not modified, but the supporting body 7 is permanently secured thereto, with the sectioin 7' thereof partially overlapping the top edge of the wrapper 3 or the adjacent portion of the flip-top box container 1, including the liner 1*b* thereof, as shown in FIG. 9B.

In this embodiment, the supporting body 7 has the fuel container formed directly therein, as indicated at 34, to receive a sheet of impervious material 35 and suitable fuel. The sheet of impervious material 35 has the wick 36 formed as a part thereof, and when the sheet 35 is in place in the fuel container 34, the wick 36 will be exposed through the opening 14 in the section 4' of the supporting body. A sealing element is shown at 37 which may be located over the open end of the wick 36, to be removed when the pack is opened for use and then discarded.

In this embodiment of the invention, as shown in FIGS. 9A and 9B, the spark wheel is indicated at 38, having the web portion thereof formed of cushion or yieldable material with or without a separate hub, as indicated at 39, so as to permit the periphery of the wheel to yield radially of its axis into and out of contact with the flint 10. The yieldable spark wheel makes unnecessary the leaf spring mounting of the flint, which can be secured directly on the fuel container 34. This spark wheel 38 is adapted to be mounted on a journal 40 which is molded or formed directly on the supporting body 7 or is secured thereto and projects outwardly as an effective journal support for the spark wheel.

Another embodiment is shown in FIGS. 10A and 10B, being applied respectively to soft-type and flip-top box-type cigarette packs, FIGS. 10A showing the parts partially disassembled, while FIG. 10B shows the parts assembled respectively thereon. In this form of the invention, the fuel receptacle is indicated generally at 41, located inside the outer wrapper of each pack, between the inner and outer wrappers thereof, with the wick 11 extending out of the fuel receptacle to the opening 14.

The spark wheel 38 is mounted on a pin 40' which is carried by the supporting body 7 that extends toward the end wall of the pack. Otherwise, the structure operates in the manner described above.

FIGS. 11A and 11B show a further modification of the invention wherein the lighter structure is supported directly by the pack and is formed in part by the wrapper thereof with a fuel receptacle 42 formed in an end wall thereof and having the spark wheel 38 mounted on a journal pin 44 which is secured to or formed on the end wall of the pack. The flint 10 is mounted on a wall of the fuel container 42. Also in this form, the cap 18 is held in place by a member 45, which is a part of the wrapper of the pack and which replaces the leaf spring 22 described above.

It is also possible, according to this invention, that the portion of the pack adjacent the igniting means may be made flame resistant, as indicated at 46 in FIGS. 11A and 11B. This may be done by using a nonflammable material, such as, for example, foil, either for the wrapper itself or for application over the portion of the wrapper adjacent the lighter structure. It may also be protected by applying a suitable coating over this portion of the wrapper.

Except as described above, the cigarette pack and lighter structure shown in FIGS. 7 to 11 operates in the same manner as set forth above with respect to FIGS. 1 to 6.

The lighter structures illustrated in FIGS. 2 to 6 are designed to be incorporated in most cigarette packs without requiring a significant change in the cigarette pack or lighter structure. The dimensions of the lighter structure should be specified to adapt to any specific pack of cigarettes in any desired manner; however, essentially the unit would remain the same. It can be attached to the pack by any adequate means desired, such as, for example, rivetted, bonded, crimped, inserted, etc.

The lighter structure can be incorporated in a cigarette pack internally or externally, in either way it is designed not to effect the original appearance and design of the cigarette pack. Being almost perfectly flat, it can be easily camouflaged by merely decorating it to match the color scheme of the pack. It can also be decorated so as to achieve a more elegant look, or for a desired publicity effect, etc.

Since cigarette packs usually are made of flammable materials, the lighter structure is designed to protect the pack from coming in contact with the flame, and consequently being fully safe to operate. Being a disposable item, together with the pack, once the unit has serviced the whole pack, there would be very little fuel left in it when discarded.

The component parts of the unit are all designed for maximum simplicity and should be carefully specified in order to be manufactured at the lowest possible cost. The number of part composing the unit should be reduced to a minimum. The actual methods employed in manufacturing the unit should be standard methods used in industry to produce simple items requiring high rates of output.

If the cigarette pack has insufficient strength of wall structure at or adjacent the point of combining with the lighter structure, additional reinforcing may be provided by incorporating any form thereof as, for example, ribs in the wall structure, adding strengthening members, substituting a heavier or different material, etc.

Designing the adaptable lighter structure presented several obstacles:

First, the fuel reservoir of the lighter structure had to be large enough to contain the necessary fuel to service an entire pack of cigarettes, and at the same time it had to be designed to occupty as little space in the pack as possible.

Second, all component parts had to be designed and arranged for maximum compactness, in order to minimize the space required by the unit.

Third, it had to be designed so as to be incorporated in a pack in the easiest and least expensive way possible, and without influencing the actual design of the pack.

Fourth, it had to be designed so as to be incorporated in a cigarette pack without effecting the actual aesthetic design or construction of the pack.

Fifth, it had to be designed so as to be combined with the cigarette pack without affecting the packing of the cigarettes.

Sixth, it had to be designed so that it could be incorporated in all types of cigarette packs, without requiring a significant change in the cigarette pack or the lighter structure.

Seventh, it had to be designed and interrelated with the cigarette pack so as to form a combined shape that would fit in conventional cartons and in vending machines.

Eighth, it had to be designed so as to be integrated in a cigarette pack to be readily accessible therein and to be operated in a simple and comfortable manner.

Ninth, it had to be safe to operate, so as to prevent the pack of cigarettes from coming into contact with the flame.

Tenth, it had to be designed so as to be manufactured in the simplest and least expensive manner to be commercially feasible.

The improvements would eliminate most of the inconveniences associated with the usage of matches or a separate cigarette lighter, such as buying a separate lighter or matches; the expense of paying an unnecessarily high price for a lighter structure; carrying an unnecessarily heavy and bulky object, such as a separate lighter structure or matches; carrying and handling two separate items, arraning or interrelating a cigarette pack with a separate lighter structure or with matches in such a manner as to be carried compactly and conveniently in a pocket or in a purse; searching uncomfortably for the separate lighter or the matches in the purse or pocket; carrying a lighter or matches after the cigarette pack is consumed and discarded; the maintenance of a separate lighter; exhausting the fuel or matches; malfunctioning of the lighter or matches; losing or forgetting the lighter or the matches; using unnecessary hand movements for lighting a cigarette.

In connection with children, the invention is much safer to use than conventional separate lighters or matches, since it contains just enough fuel to service the cigarettes in the entire pack and thus, after the pack has been exhausted it has practically no dangerous life left, while normally used separate lighters or matches are almost constantly a potential hazard to children.

I found the most appropriate reservoir design to be a container having a very thin rectangular shaped cross section and designed to fit flatly against the side of the cigarette pack. This type of reservoir offers maximum fuel storage capacity with a minimum reservoir thickness. Once incorporated in the pack, it takes up a minimum possible space, protruding a minimum amount therefrom, while covering a relatively large part of the wall surface of the pack.

Being so thin, the lighter structure can be barely noticed if attached externally to a pack of cigarettes, and if incorporated internally, it would not influence the actual packing of the cigarettes, since it normally only needs to protrude about 1/16 inch or less from the pack's wrappings. Due to its thinness, it is possible to use die impression to form the fuel reservoir and other component parts such as tubular rivet on the thin sheet of suitable material composing the body of the unit. This would lower the unit's manufacturing cost tremendously by reducing the number of independent parts as well as the number of manufacturing operations required to make the unit, as well as by making it possible to manufacture to unit at very high rates of output.

The spark wheel and the flint have been arranged compactly together, in order to leave maximum remaining space for the fuel reservoir. The spark wheel has the necessary thickness and projects a sufficient amount to feel confortable on the thumb when the fingers embrace the pack and does not effect the packing of the cigarettes or the construction of the pack. Even though the spark wheel is very thin, it can generate a spark that will light the wick or the gas in the respective lighter units. The flint can be incorporated in the lighter structure as a performed solid or a premixed paste and having the minimum required dimensions.

The overall symmetry of the cigarette pack is not changed by the combining therewith of the lighter structure. It will still fit in standard sized packages and in vending machines. According to this invention, both the disposable lighter structure and the cigarette pack should be assembled together as one in the manufacturing process so as to form a combined commercially feasible product. These are then sold as a single combined product and, after use, are disposable together as one unit. In other words, the lighter structure has only sufficient fuel to ignite the cigarettes in the pack, one by one, but should be substantially exhausted when that number of cigarettes has been used.

. The several forms of lighter structure or combined cigarette pack and lighter structure may be modified as found desirable and suitable. For example, any form thereof may use a fixed flint and resiliently mounted spark wheel, or variations in mounting of the spark wheel, journal etc.; or different types of igniting mechanisms, such as means for linear movement for generating a spark; or different mechanisms for controlling the operation of the gas to the lighting means, etc.; or variations in connections between the lighter structure and the cigarette pack, etc.; or omitting parts thereof as described, for example, the impregnable material.

The lighter structure can be incorporated with the cigarette pack at any desired point.

Other types of inexpensive, disposable lighter structures may be used, such as an electrical lighter, operated by a dry cell battery.

The dimensions set forth are for purpose of illustration only, to indicate the compact nature of the lighter structure, that it will blend compactly with the cigarette pack at the open end thereof and may be enclosed in the wrapper thereof besides the cigarettes C, or encased by the sealing enclosure.

While the invention has been illustrated and described in certain embodiments, it is recognized that other variations and changes may be made therein without departing from the invention set forth in the claims.

I claim:

1. A cigarette pack comprising a disposable container for cigarettes and having enclosing walls for said cigarettes, and a lighter structure including a supporting wall extending alongside one of the container walls and permanently secured thereto, means forming a fuel container and having means for directing the fuel therefrom, and igniting means for the fuel, said one container wall being recessed to form the fuel container in cooperation with said supporting wall.

2. A cigarette pack according to claim 1, wherein the igniting means includes a spark wheel, and the fuel container extends substantially throughout the area of said supporting wall with a thickness of the receptacle transversely of the wall substantially no greater than the width of the spark wheel.

3. A cigarette pack according to claim 1, wherein the cigarette container has a flexible foldable sheet enclosure encasing the container and the lighter structure.

4. A cigarette pack comprising a disposable container for cigarettes and having an enclosure wrapper extending therearound and a disposable lighter structure, said container having an upper end adapted to be opened for access to the cigarettes, said lighter structure including a supporting body secured permanently in integral relation to a side of the wrapper and extending continuously to the upper end of the container, igniting means carried by the supporting body and including a fuel receptacle and means for igniting the fuel, said igniting means being at least partially enclosed by the supporting body between the latter and the wrapper, the top wall of said lighter structure having a portion extending over a portion of the cigarette container to form a shield for the cigarettes and having an opening therein for the flame produced by said igniting means.

5. A cigarette pack according to claim 4, wherein the cigarette container has an enclosure encasing the container and the lighter structure.

6. A cigarette pack comprising a cigarette container, and a cigarette lighter having a fuel receptacle and lighting means including a rotary spark wheel, said cigarette lighter being permanently secured to a side wall of the container, said container side wall having an opening therein, and a journal member mounted in the opening and supporting the spark wheel.

7. A cigarette pack comprising an elongated container for cigarettes and having an end adapted to be opened to withdraw cigarettes therefrom, and a lighter structure including a supporting wall with a laterally turned section overlapping said open end portion of the pack, said section having an opening therein, a fuel reservoir carried between the supporting wall and the container, means for directing fuel from said reservoir to the opening, and igniting means for the fuel.

8. A cigarette pack according to claim 7, wherein the igniting means includes a rotary spark wheel and the fuel reservoir extends over the supporting wall substantially throughout the area thereof and has a width transversely to said wall substantially no greater than the width of the spark wheel.

9. A cigarette pack according to claim 7, wherein the cigarette container has an enclosure encasing the container and the lighter structure.

* * * * *